US007007751B2

(12) United States Patent
Eggleston

(10) Patent No.: US 7,007,751 B2
(45) Date of Patent: Mar. 7, 2006

(54) APPARATUS FOR EXTRACTING OIL OR OTHER FLUIDS FROM A WELL

(76) Inventor: Philip W. Eggleston, 1813 Sandra Dr., Sherman, TX (US) 75092

( * ) Notice: Subject to any disclaimer, the term of this patent is extended or adjusted under 35 U.S.C. 154(b) by 65 days.

(21) Appl. No.: 10/443,353

(22) Filed: May 22, 2003

(65) Prior Publication Data

US 2004/0020637 A1 Feb. 5, 2004

Related U.S. Application Data

(63) Continuation-in-part of application No. 10/106,655, filed on Mar. 26, 2002, now abandoned.

(60) Provisional application No. 60/290,252, filed on May 11, 2001.

(51) Int. Cl.
*E21B 43/00* (2006.01)
*F04F 1/06* (2006.01)

(52) U.S. Cl. ..... 166/162; 166/369; 294/68.22; 417/118

(58) Field of Classification Search ..... 417/118; 294/68.22; 166/369–372, 162, 69
See application file for complete search history.

(56) References Cited

U.S. PATENT DOCUMENTS 997,661 A * 7/1911 Ellison ..... 417/118
1,145,158 A 7/1915 Mapes
1,372,031 A 3/1921 McKissick
1,447,992 A 3/1923 Layne et al.
1,523,604 A 1/1925 Miller
1,603,675 A 10/1926 Folsom et al.
2,078,322 A 4/1937 Gage
2,145,753 A 1/1939 Coulter
2,180,864 A 11/1939 Connor
2,661,697 A 12/1953 Long et al.
2,956,511 A 10/1960 Morehead
2,990,780 A 7/1961 Kreuter
3,034,440 A 5/1962 Hermanson
3,075,466 A 1/1963 Agnew et al.
3,113,522 A 12/1963 Coberly
3,963,374 A 6/1976 Sullivan
3,998,568 A 12/1976 Hynd
4,086,035 A 4/1978 Klaeger, Jr. et al.
4,439,113 A 3/1984 Owen
4,583,916 A * 4/1986 Senghaas et al. ..... 417/36
4,603,735 A 8/1986 Black
4,678,040 A * 7/1987 McLaughlin et al. ..... 166/370
5,028,213 A 7/1991 Dickinson et al.
6,216,789 B1 * 4/2001 Lorsignol et al. ..... 166/355
6,464,012 B1 * 10/2002 Strickland ..... 166/369

* cited by examiner

*Primary Examiner*—David Bagnell
*Assistant Examiner*—G M Collins
(74) *Attorney, Agent, or Firm*—Konneker & Smith, P.C.

(57) ABSTRACT

The present invention is directed towards a fluid extractor system that has been design to obtain fluid, such as crude oil from wells at a fraction of the cost by using a novel canister assembly lowered in a well to collect the fluid. The canister assembly includes a pump and a storage container for collecting the fluid pumped into it by the pump. When the storage container is full the canister assembly is brought to the surface and emptied. In one embodiment the canister assembly has a battery to independently power the pump. A further feature of the invention includes repeatedly raising and incrementally lowering down the canister assembly to lower levels in the well using a jogging assembly to place the canister assembly only in the top layer of the fluid in the well. The system could also be used for recovering several other types of fluids in a well such as gas or water.

7 Claims, 10 Drawing Sheets

APPARATUS FOR EXTRACTING OIL OR OTHER FLUIDS FROM A WELL

CROSS-REFERENCE TO RELATED APPLICATION

This application is a continuation-in-part of U.S. patent application Ser. No. 10/106,655 filed on Mar. 26, 2002 now abandoned entitled "An Apparatus for Extracting Oil or Other Fluids from a Well" that in turn claims priority from U.S. Provisional Application Ser. No. 60/290,252 filed on May 11, 2001 entitled "An Apparatus and System for Extracting Oil".

FIELD

The present disclosure is directed towards an extractor system that has been designed to recover fluids such as oil, gas, or water from wells at a fraction of the cost by using a canister assembly that may includes a pump and a storage container for retrieving the fluid.

BACKGROUND

There are a couple types of pumps for wells, especially deep wells such as oil wells. The most commonly used pumps include pump jacks or reciprocating pumps. Pump jacks or reciprocating pumps use small diameter pumps that fit down in a well and are fitted to discharge tubing that is used to transport fluid to the surface. These pumps are often operated by sucker rods, which operate the pump pneumatically. Examples of these types of pumps are disclosed in U.S. Pat. Nos. 1,603,675 and 2,180,864. Problems often occur with these types of pumps because of the weight of the fluid and the power required to pump it up the long column (which can be thousands of feet long) formed by thirty-foot sections of discharge tube. When these problems occur, the discharge tubing and sucker rods must be disassembled before the pump can be brought to the surface for repair.

Another type of pump that is currently being used is a bailer pump. These pumps operate much like the ancient rope and bucket approach. A bailer is lowered into the well and allowed to sit in the fluid long enough for it to fill the bailer. A timer is often used to control the amount of time the bailer is in the fluid to insure that fluid has had enough time to seep into the bailer to fill it before the bailer is pulled to the surface and emptied. An example of this type of well is shown and described in U.S. Pat. No. 4,086,035. Often the issue with these types of pumps is that they are not very efficient. Time is lost because the bailer is sent to a constant depth which is often well below the surface level of the fluid to insure that it recovers fluid with each cycle. Fluid typically enters a hole in the bottom of the bailer and a check valve is used to prevent it from leaking out when the bailer is brought to the surface. Further, for oil wells, if water is present and rises to that predetermined level, water will be recovered with the oil. Time may also be lost waiting for the fluid to seep into the bailer, if the seepage rate is unknown. Plus a mess is likely when the bailers are dumped at the surface.

SUMMARY

Unlike most conventional fluid recovery techniques, which place either a pump or bailer in the well to pump fluid to the surface, the present disclosure places a canister in the well that may have both a pump and a storage container.

According to one embodiment of the canister, when the canister is in the well, the pump is activated and fills the storage container when fluid such as oil is detected. At timed intervals, which may depend on the amount of fluid in the well or the recovery rate of fluid in the well, the canister assembly is pulled to the surface and its contents in the storage container emptied using compressed air from a compressor. In other words, when the canister is brought to the surface of the well, a compressor is automatically connected to canister using a discharge head and compressed air forces the fluid out of the canister. The discharge head provides two plenums, which align with at least two holes in the canister for providing a fluid connection to the compressor and a discharge port. Once emptied, the canister assembly is then lowered into the well to recover more fluid.

In an alternative embodiment, the canister is not equipped with a pump. Fluid is allowed to seep into the top of the canister through at least a first hole, which will later be connected to the compressor to force the fluid out of the canister. A second hole is provided and is connected to the discharge port of the discharge head when the canister is at the top of the well. When compressed air is introduced into the canister, fluid is forced up a tube in the canister and out through the second hole. A third hole maybe provided to allow air to escape while fluid seeps into the first hole of the canister. Preferably the third hole is located above the first hole.

The present disclosure also describes an efficient method and apparatus for extracting only oil. Often a wellhead or column of oil forms in the well on top of a salt-water layer. According to the present disclosure a jogging assembly is provided to minimize the travel of the canister assembly up and down the well and to stop just above the salt-water layer to avoid pumping water. In other words, the jogging assembly causes the canister assembly to be lowered into the well at incrementally lower levels to place the canister assembly in only the top layer or column of oil. The jogging assembly accounts for the dropping level of the oil as it is pumped out of the well and can be further adjusted to compensate for rising levels of water in the well as the oil is pumped out.

According to the present disclosure an extractor assembly for recovering fluid includes a canister assembly that has a storage container for storing the recovered fluid and a pump for pumping the fluid from the well into the storage container. In one embodiment the canister further includes a battery for independently powering the pump. In another embodiment, the canister only contains a storage container having a tube placed in the container for allowing fluid to be forced to the top of the container through the used of pressurized air when the canister is emptied at the top of the well.

A base assembly is used for lowering and raising the canister into and out of the well. The base assembly may also include a discharge head that engages with the canister assembly when it is raised to the top of the well to provide for an electrical connection between the battery and a battery charger. The discharge head may also be used as a conduit for connecting a compressor to the canister assembly for providing pressurized air to the storage container when the canister assembly has been raised to the top of the well for emptying its contents.

A jogging assembly may also be attached to the base assembly to incrementally lower the canister assembly into the well with each recovery cycle. The jogging assembly may further include means to prevent the base assembly from lowering the canister assembly below a predetermined level in the well. Preferably the jogging assembly has a lead screw that has a threaded portion that rotates along its axis as the canister is lowered into the well causing a follower to travel towards a limit switch used to turn off a motor that is used to lower the canister in the well. Jogging means is further provided for incrementally increasing the distance between the limit switch and the follower with each fluid recovery cycle to cause the follower to travel further distances with each fluid recovery cycle and thereby causing the canister assembly to be lowered further into the well with each recovery cycle. The increments that the canister assembly is lowered with each recovery cycle can be predetermined.

While this invention will primary be described a device for recovering oil, it could be easily used for recovering other fluids, such as water or gas. As will be realized by those skilled in the art, the present disclosure also provides additional unique functions and features. For example the design is compact and provides for low maintenance. The extractor unit can be either powered by AC or DC, which would enable extraction of oil in remote places where AC power is not readily available. The design is also inexpensive to make and to operate.

BRIEF DESCRIPTION OF THE DRAWINGS

The foregoing and other objects and advantages of the disclosure below will become clearer with reference to the following detailed description as illustrated by the drawings in which.

DETAIL DESCRIPTION

Figure 1:
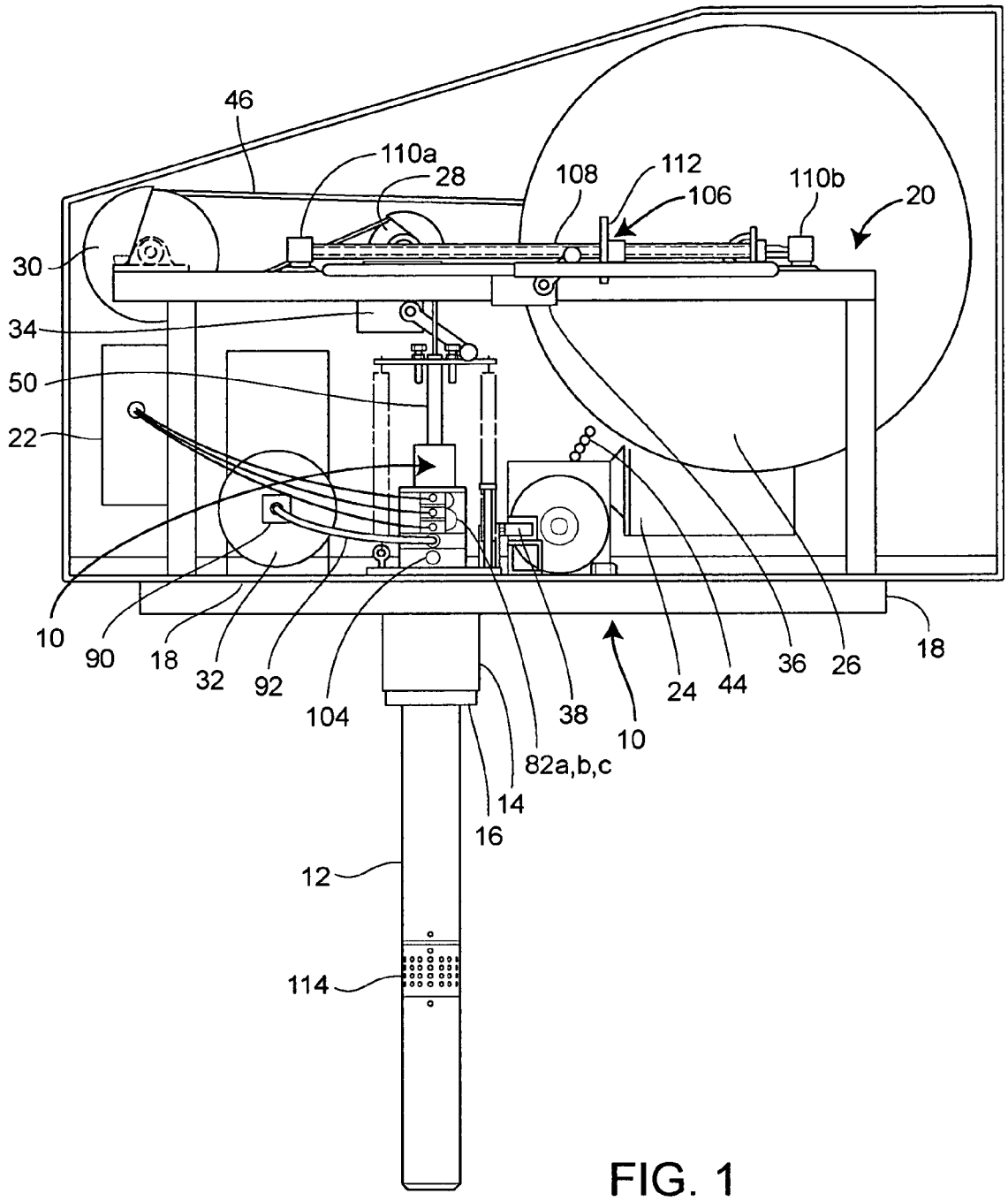
FIG. 1 is a schematic diagram of the extractor system of the present invention.

The extractor system shown in FIG. 1 basically consists of two components; a surface base assembly 10, and a canister assembly 12 that is lowered down a well by the base assembly 10 to retrieve fluid such as oil, gas, or water. The preferred method of installing the extractor to the well includes fitting a tube 14 attached to the bottom of the base assembly 10 and placed over the top of a well casing 16. Attaching the tube 14 to the well casing 16 can be accomplished in a number of ways such as by bolting, screwing, or clamping the tube 14 to the top of the well casing 16. Alternatively, the base assembly could be mounted to a platform (not shown) around the well. Other methods for mounting the assembly is also possible and should become apparent to one skilled in the art depending on the circumstances of and access to the well.

The Base and Canister Assemblies

Figure 8:
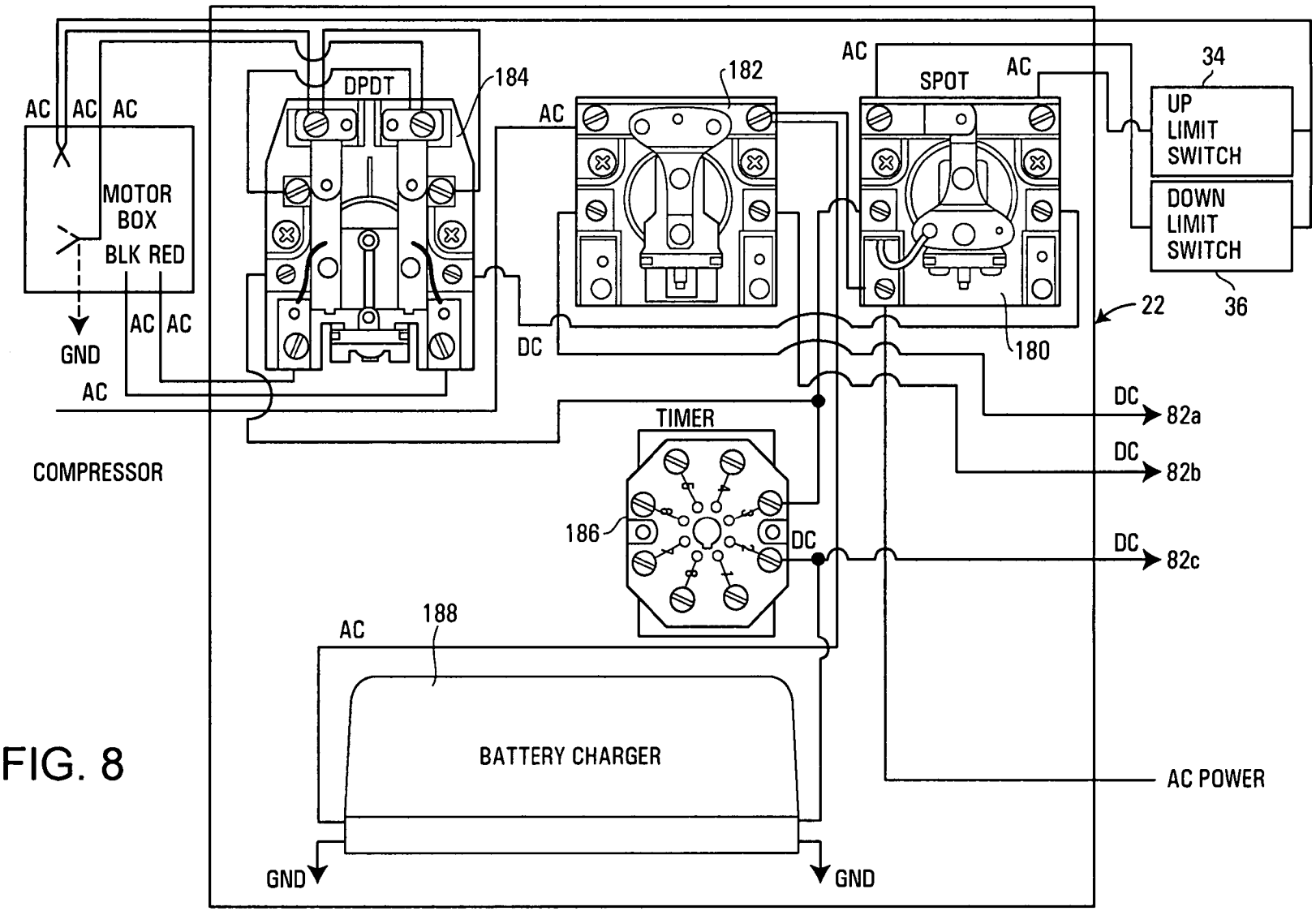
FIG. 8 is a schematic diagram illustrating the components of the electrical enclosure shown in FIG. 1.
Figure 9:
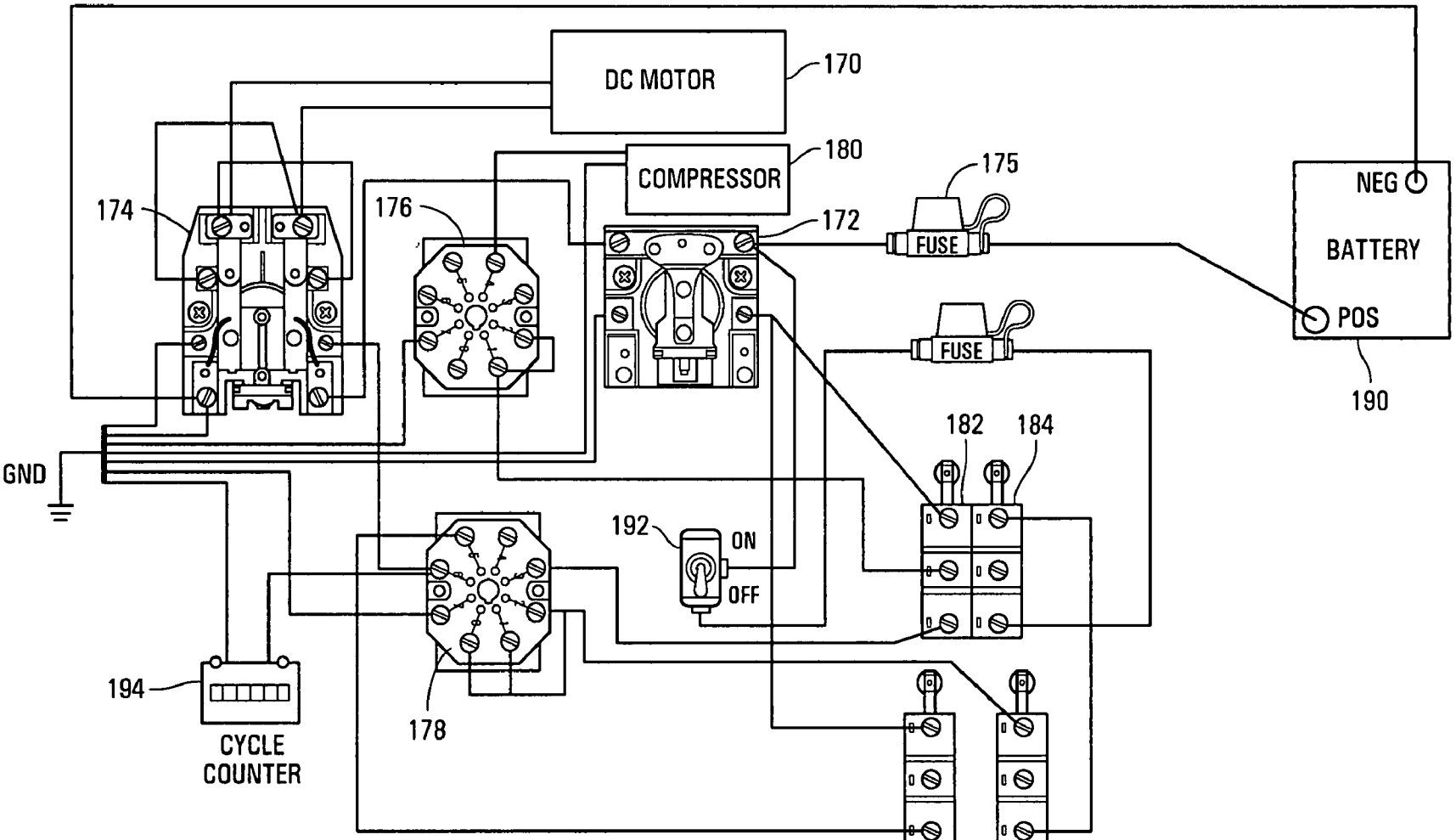
FIG. 9 is an alternative schematic diagram illustrating the components of the electrical enclosure when the Extractor Unit is powered by DC.

The Base assembly 10 includes a base 18 and a structural platform 20 secured to the base for supporting an electrical enclosure 22, a motor/gearbox assembly 24, a spool of cable 26, pulleys 28 and 30, an air compressor 32, limit switches 34, 36, and 38, and a discharge head 40. The cable, as well as the other component parts such as the pulleys 28 and 30, motor/gear box assembly 24, air compressor 32 and limit switches 34, 36, and 38, is a standard off-the-shelf component. Similarly, the electrical enclosure 22 includes standard electrical components. For example, FIGS. 8 and 9 show simple wiring diagrams of the electrical components use to operate the extractor system. As illustrated, in FIG. 8 three solenoids operated relays 180, 182, 184, a timer 186, and a battery charger 188 are included. One solenoid 180 is used to start and stop the motor/gear assembly 24. Another solenoid 182 is used for starting and stopping the compressor 32. The third solenoid 184 is used for reversing the direction of the motor/gearbox assembly 24. Similarly standard, off the shelf electrical components are used in FIG. 9. These and the other components will be discussed in greater detail below. As one skilled in the art will appreciate in view of the discussion below, the selection of all of the above parts will generally depend on the load, capacity, and application of the extractor assembly.

The discharge head 40, which will be discussed in greater detail below, is mounted directly above the canister assembly 12, and positioned over the well opening. The primary purpose of the discharge head is to dispense and receive the canister assembly 12 into and out of the well and empty the oil from the canister assembly. As discussed below, it may also be used to charge a battery 76 (FIG. 3) placed inside the canister assembly or as a conduit to supply pressurized air from the compressor to empty the fluid contents of the canister assembly 12. A hood 42 may be placed over the base assembly 10 to protect the component parts of the extractor system.

The canister assembly 12 is a device that generally includes a storage container 78 and a pump 80 for filling the storage container with fluid from a well. In the shown embodiment, a battery 76 independently powers the pump 80. Alternatively, the canister assembly 12 itself maybe a storage container without a pump. Essentially, fluid is collected in the container by allowing fluid to seep into a hole placed near the top of the canister. The canister assembly 12 will also be discussed in greater detail below and generally with reference to FIGS. 3, 3A, and 5.

Figure 2:
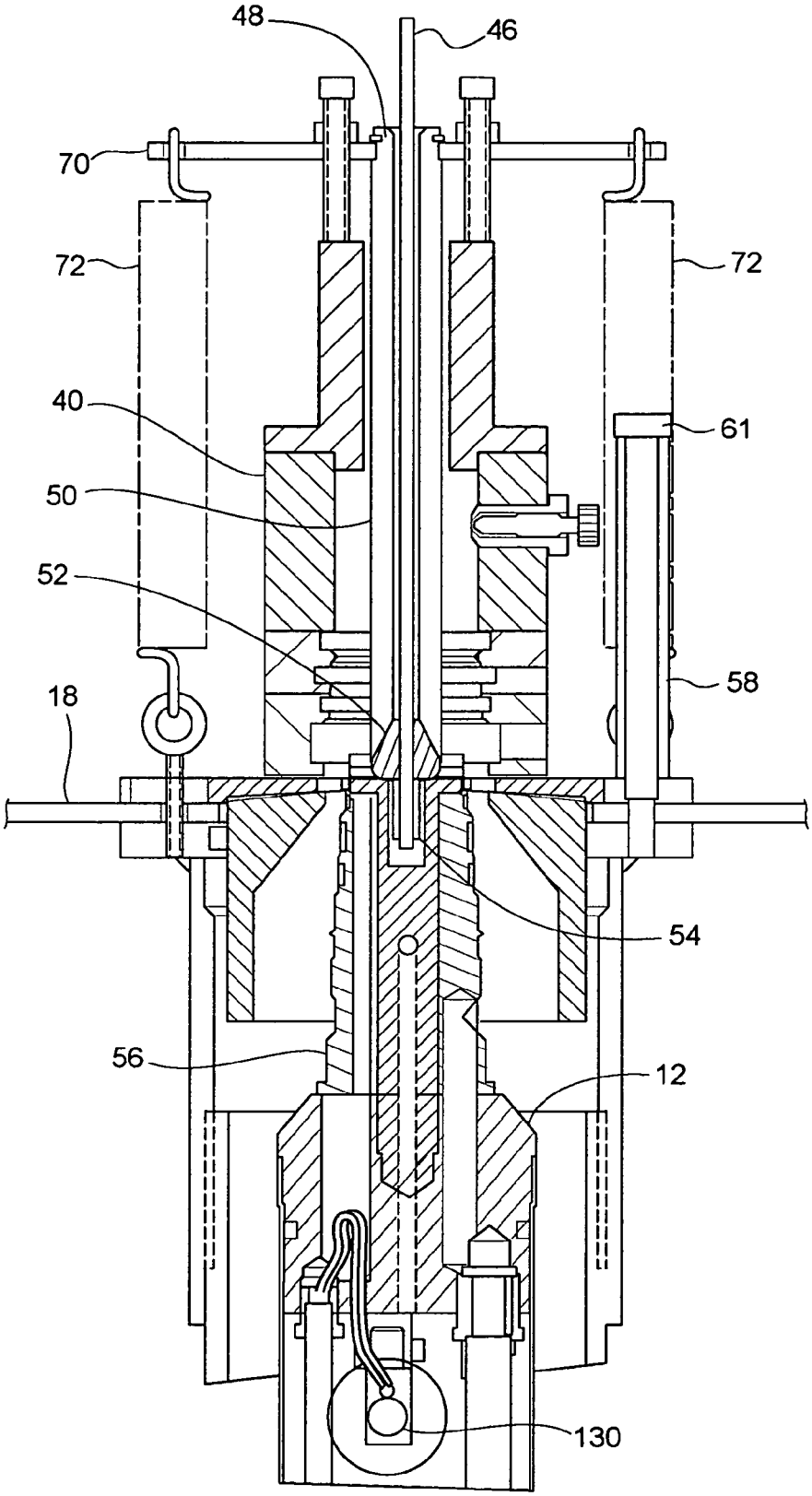
FIG. 2 is a partially cross sectional view of the discharge head and a portion of the canister assembly depicted in FIG. 1 as it engages with the discharge head.

The canister assembly 12 is attached to a cable 46 and is raised and lowered into the well by rotating the spool of cable 22. The motor/gear box assembly 24 connected to the spool operates the spool 26 by a drive chain 44. As shown cable 46 is threaded from the spool of cable 26, around pulleys 28 and 30, and through a hole in the center of a centering rod 50 slidably mounted in the discharge head 40. Referring to FIG. 2, the cable 46 is connected to the canister assembly 12 by first feeding it through a hole in a nose flange 52, as shown, and then by crimping it to a cable stop 54 (such as a ferrule), which prevents the cable 46 from coming out of the nose flange 52. The nose flange 52 is attached to a nose portion 56 of the canister assembly 12 by bolts or other suitable means (not shown). Other suitable methods for attaching the cable to the canister assembly is possible and should be apparent to one skilled in the art.

Figure 4:
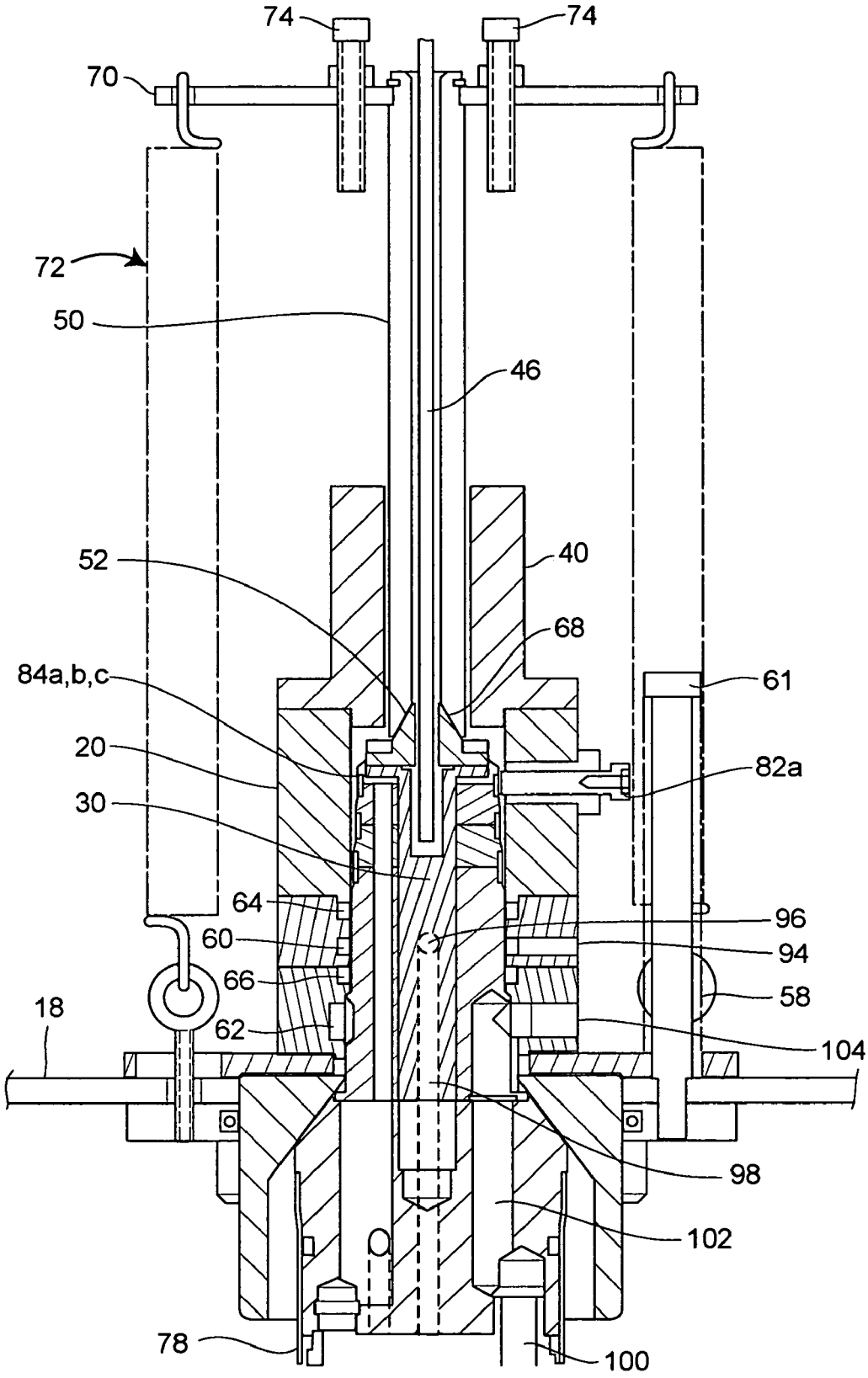
FIG. 4 is a partially cross sectional view of the discharge head and a portion of the canister assembly depicted in FIG. 1 fully engaged with the discharge head.

Referring now to FIGS. 2 and 4, it is important that the discharge head properly receive the nose portion 56 of the canister assembly 12 so that it is engaged at the correct depth without hanging up on the inside diameter of the discharge head 40. Proper alignment allows for air and oil plenums 60 and 62 to be formed between the discharge head 40 and the canister assembly 12 to create pressurized passageways that will be used to pump the oil from the canister assembly. The plenums 60 and 62 are preferably formed by grooves around the circumference of the discharge head 40 and the nose portion 56 of the canister assembly 12. Seals 64 and 66 are provided on each side of the air plenum 60. Proper alignment also ensures that proper electrical contacts are made to charge the battery, as will be discussed in greater detail below.

The centering rod 50 protruding down through the center of the discharge head 20 is spring loaded and accomplishes the centering process. The centering rod 50 has a countersink shape at one end 68 to match the tip on the nose flange 52 of the canister assembly 12 as shown, and is sized to freely slide up and down within the discharge head 20. A plate 70 is attached to the other end of the centering rod 50 and is biased toward the base assembly 10 by two tension springs 72, thereby biasing the centering rod toward the canister assembly. The tension springs 72 are connected to the bottom of the base 18 as shown. Bolts 74 are provided to adjust the bias of the springs 72, if necessary, and to provide a travel stop for the centering rod 50.

During operation, as the nose flange 52 of the canister assembly 12 is raised and makes contact with the centering rod 50, it pushes the centering rod assembly 50 up into the discharge head 40 stretching the tension springs 72 as shown in FIG. 4. This additional load causes the nose flange 52 of the canister assembly 12 to seat in the centering rod counter sink end 68 thereby holding canister nose portion 56 in the center of the discharge head 40. The springs 72 are also used to push the canister nose portion 56 out of the discharge head 40 when the canister assembly 12 is lowered back into the well, which also keeps the canister nose portion 56 from hanging up in the discharge head 40.

The above resolves the centering problem, but not the angle alignment problem. Generally when the base assembly 10 is mounted to the well it may not always provide for a perfect alignment of the canister assembly 12 and the discharge head 40. To insure the nose of the canister assembly 12 enters the discharge head 40 at the correct angle, the discharge head 40 is given enough freedom to allow it to tilt. To accomplish this the discharge head 40 is bolted to the base 18 using four springs 58 and four alignment bolts 61 positioned in the center of the springs 58. (To minimize the complexity of the drawings, only one pair of springs and guild bolts is shown in FIGS. 2 and 4). As the canister nose portion 56 continues into the discharge head 40, after making contact with the centering rod 50, it makes contact with the inside diameter of discharge head 40 (as shown in FIG. 4). This contact tends to force the discharge head 40 to tilt at the same angle as the nose of the canister assembly 12 thereby insuring that the canister nose portion 56 will seat in the discharge head 40 at the proper angle and height. The canister assembly 12 travel is stopped when the plate 70 rises to a set point where it makes contact with a limit switch 34 (more clearly shown in FIG. 1), shutting off the spool motor/gearbox assembly 24.

The assembly of the four springs 58 and alignment bolts 61 also allow for over travel, as the canister nose portion 56 seats in the discharge head 40. Typically a small amount of over travel occurs before the spool of cable 26 stops. This over travel is taken up by the four springs 58 pushing on the base of the discharge head 40, keeping the load on the cable 46 and within a safe limit as the canister nose portion 56 and discharge head 40 comes to a stop. A second safety limit switch 38 may be provided to stop the motor if the discharge head 40 travels too far or the first limit switch 34 fails.

Figure 3:
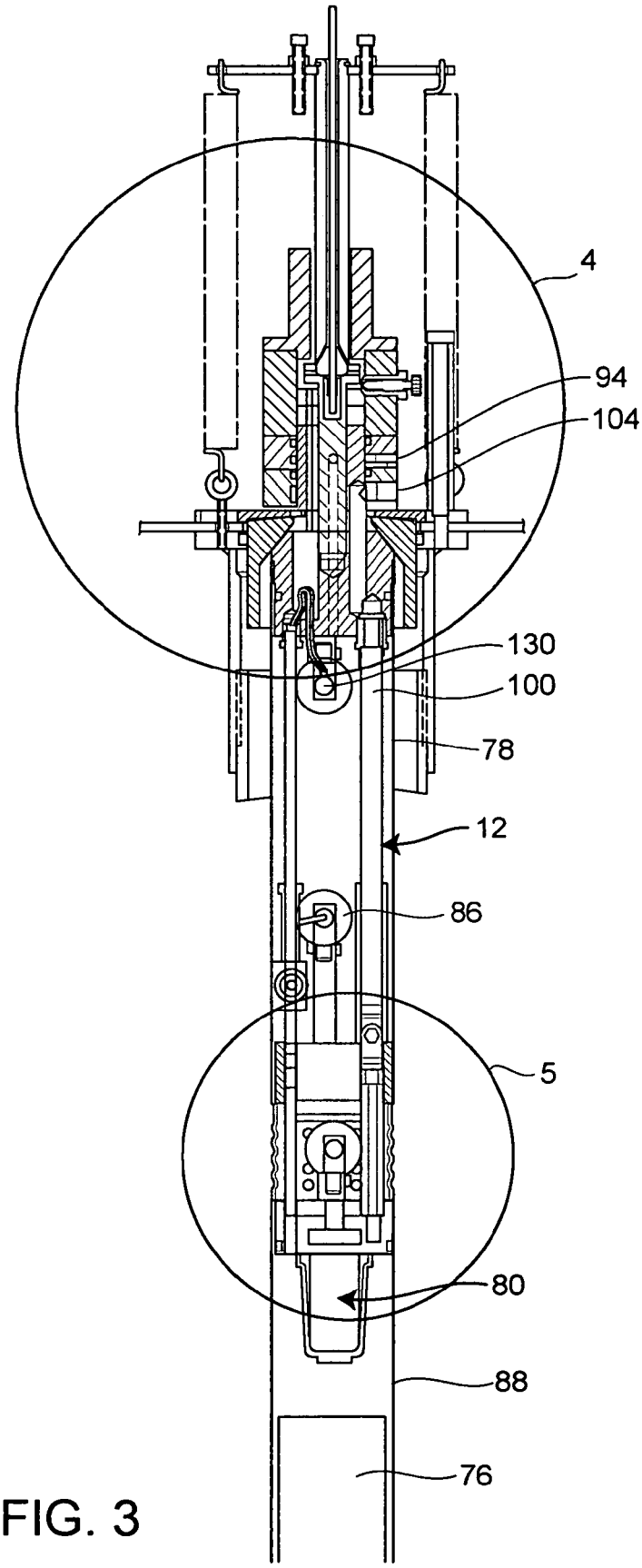
FIG. 3 is a partially cross sectional view of the discharge head and the canister assembly depicted in FIG. 1.

Referring now to FIGS. 3, 4, and 8, once the canister nose portion 56 has seated in the discharge head 40, the battery 76 is charged and oil is removed from the storage container 78 (FIG. 3). Both are accomplished when electrical contact is established between three electrical contacts 82*a*, 82*b*, and 82*c*, mounted in the discharge head and wired to the electrical enclosure 22 and three metal bands 84*a*, 84*b*, and 84*c* mounted on the canister nose 30. For clarity only one of the electrical contacts 82*a* is shown in FIGS. 3 and 4. By having metal bands as contacts, the rotational orientation of the canister assembly coming out of the well is not important. Wires (not shown) electrically connect these metal bands 84*a*, 84*b*, and 84*c* to the battery 76 and to a fill sensor 86, which is basically a float sensor. Two of the contacts 82*b* and 82*c* are used as charging lines, which feed D.C. power from a battery charger 188 mounted in the electrical enclosure 22 (FIG. 8), for recharging the battery 76. Preferably the battery 76 is mounted in a sealed container 88 at the bottom of a storage container 78 located within the canister assembly 12. The battery selected in the preferred embodiment is 12 volts, but other voltages could be used depending on the requirements needed to run the pump 80. The other electrical contact 82*a* is used to feed power from the battery 76, through the fill sensor 86 mounted at the bottom of the storage container 78, to a twelve-volt relay 182 mounted in the electrical enclosure 22. The twelve-volt relay is used to open a solenoid valve 90 (FIG. 1) that controls the supply of air from the compressor, as will be explained below.

Figure 3A:
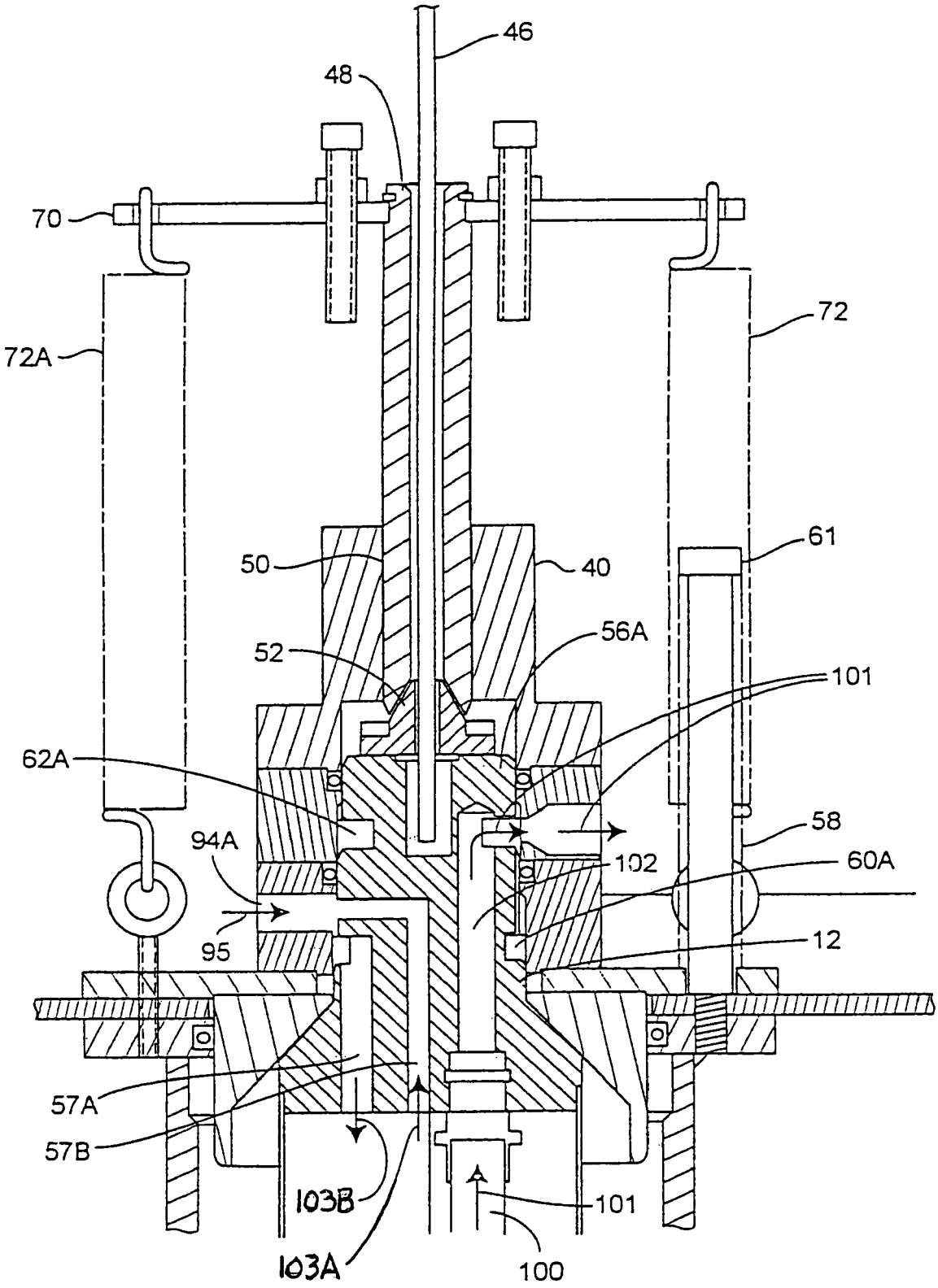
FIG. 3A is an alterative, partially cross sectional view of a discharge head and the canister assembly that is not equipped with a pump and power supply.

Referring now to FIG. 3A, an alternative canister assembly and discharge head is shown. Essentially the parts and features described above for the canister assembly are the same as indicated by the same reference numbers, with the exception that this canister assembly does not have a pump, battery, or mechanisms used to detect fluid level in the well to turn on the pump as described above. Further, there are no electrical contacts to align for charging a battery. The canister assembly is primarily a container used for collecting fluid in the well. Additional features and details of this canister will be discussed in more detail below.

Removing Oil from the Canister Assembly

Referring to FIGS. 1, 3, 4 and 8, oil is removed from the storage container 78 located in the canister assembly 12 by pressurized air. By activating the solenoid 182 (FIG. 8), pressurized air from the compressor 32 is fed through the airline 92 (FIG. 1) to the air plenum 60, via an air inlet 94 in the discharge head 40 (FIG. 4). The air plenum 60 supplies the pressurized air to an opening 96 in the center of the nose portion 56 of canister assembly 12. This opening 96 is connected to the top of the storage container 78 by an air passageway 98. As air, supplied from the compressor 32, builds up pressure in the storage container 78, it forces oil that has been collected in the storage container 78 to be forced through a discharge tube 100. The discharge tube 100 runs from the bottom of the storage container 78 to the bottom of the canister nose portion 56. Oil forced through the discharge tube 100 passes through a channel 102 in the canister nose portion 56 and into the oil plenum 62. A discharge port 104 in the discharge head 40 provides a path for the oil to be transferred to an exterior storage vessel via a transfer tube (not shown). A one-way check valve (not shown) may be located at the discharge port 104 to prevent oil from returning back to the storage container 78. When the oil level is drained to the bottom of the storage container 78, the fill sensor 86 shuts off the current to the twelve-volt relay 182 thereby closing the solenoid valve 90 to stop the airflow from the compressor 32.

After the oil has been removed from the storage container 78 and the battery 76 has been charged, a programmable timer 186 (FIG. 8) mounted in the electrical enclosure 22 energizes a motor relay 180 to start the spool motor/gearbox 24 to drop the canister assembly 12 back into the well. The timer 186 is preset to a predetermined amount of time to allow for sufficient amount of charge time for the battery, for example 10 minutes. To insure the canister nose portion 56 comes out of the discharge head 40, the spring-loaded centering rod 50 pushes on the top of the canister nose portion 56 forcing it out of the discharge head 40 as described above.

Discharging oil from the alternative canister depicted in FIG. 3A is similar. When the nose portion is fully engaged with the discharge head 40, as shown, plenums 60A and 62A are formed. Pressurized air enters the air inlet 94A (as indicated by arrow 95) to the air plenum 60A formed between the discharge head 40 and the nose portion 56A of the canister assembly 12 and into the canister assembly through channels 57A and 57B provided in the nose portion 56A. These channels will be discussed further in greater below. As pressurized air enter the canister assembly (arrow 95), fluid is forced up through the discharge tube 100, which extends to the bottom of the canister assembly, and out the channel 102 as illustrated by arrows 101. The advantage with this design is that there is no battery to charge and no electrical contacts to be aligned with electrical connection in the discharge head 40. Once the canister assembly has been emptied, the canister assembly can be immediately returned down the well to recover more fluid. No time is lost, which would otherwise be required to charge the battery.

Collecting Oil in the Canister Assembly

Before describing how the canister assembly collects oil, it should be understood that before the extractor is placed onto the well, the level of the oil and an oil/water interface, if any, is known Sensing devices commonly used today can determine the depth of the top of the oil, the head height of the oil or the depth of the oil/water interface level in the well. Once these levels have been determined, a down travel stop assembly 106 is mounted on the structural platform 20 (FIG. 1). Generally, the travel stop assembly comprises a lead screw 108 that is positioned between two pillow blocks 110*a* and 110*b* mounted to the structural platform 20 and rotates in place as the spool of cable 26 rotates. A follower 112 travels down the lead screw 108 as it rotates toward a limit switch 36 when the canister assembly 12 is lowered into the well. The travel stop assembly, which will be described in greater detail below with a jogging assembly, is set so that the canister assembly 12 will stop just above the water in the well, thereby allowing it to reside in oil only. Once the canister assembly is immersed in oil, the pump 80 located in the canister assembly 12 is then activated and only oil is pumped into the storage container 78. This technique avoids pumping oil and water into a storage container thereafter requiring it to be separated in a storage tank. Eliminating the need to separate the collected oil and water and thereafter disposing of the unwanted water will realize considerable savings.

Collecting oil in the canister assembly 12 will now be described. The canister assembly is designed to be placed in the oil and reside in the oil until the storage container 72 has been filled. Once filled, the canister assembly is raised and emptied as discussed above. As discussed above the canister assembly 12 contains a battery 76, storage container 78 and a pump 80. This enables the canister assembly to be an operationally self-contained unit, totally independent from the base assembly mounted to the well casing. As an alternative design, one skilled in the art should realize that an AC power line could be lowered with the canister assembly to power the pump. Furthermore, an expensive electrical cable could be used to both lower the canister assembly container in the well and to power the pump. It would be obvious to one skilled in the art that these designs would require replacing the DC electrical components used with AC components.

Figure 5:
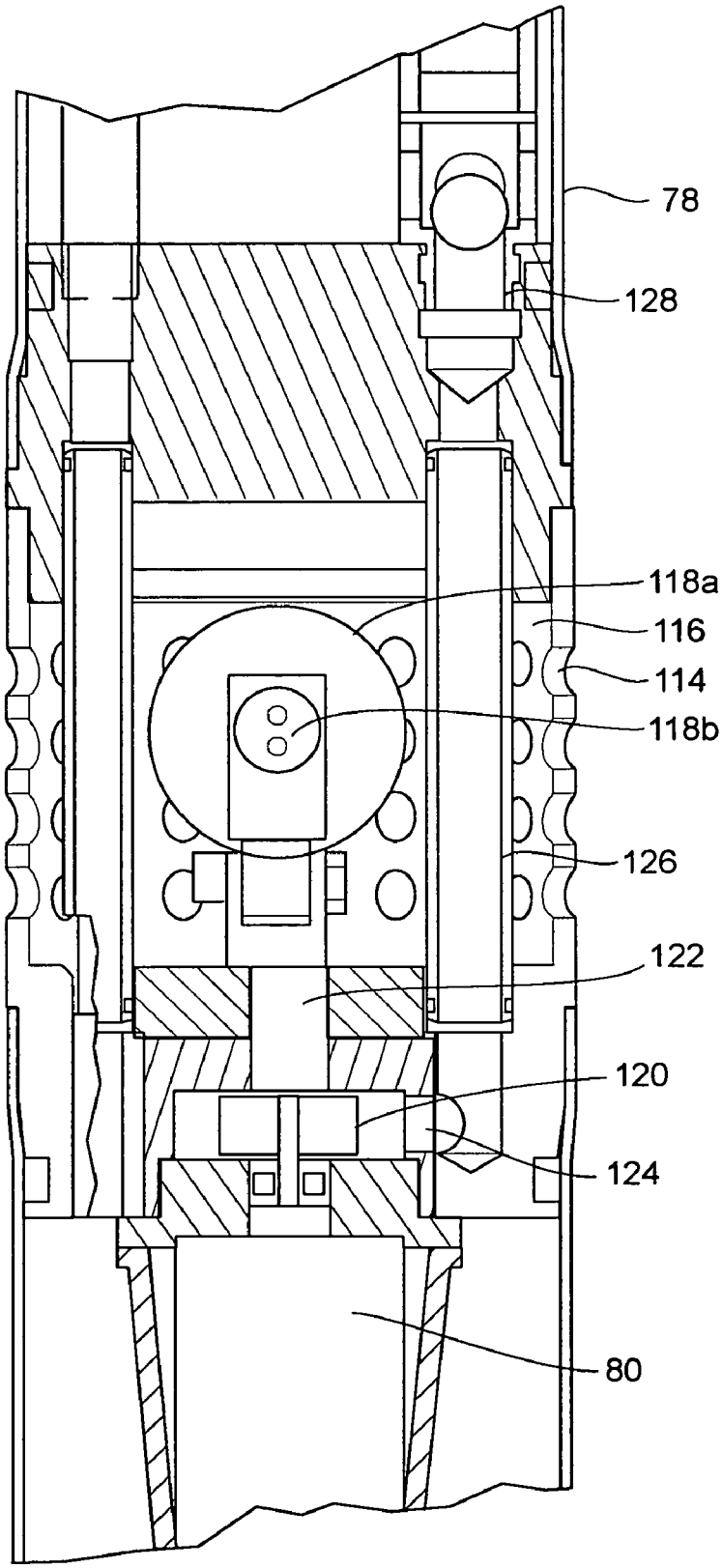
FIG. 5 is a partially cross sectional view of the canister assembly used to show how fluid is pumped into a storage container of the canister assembly.

The process of filling the canister assembly starts as soon as the canister assembly 12 is placed in the oil. Referring now to FIG. 5, oil starts to flow through a strainer 114 and fills a strainer cavity 116 as soon as the canister assembly 12 is immersed in oil. The strainer helps keep larger particle that could clog the pump from entering the canister. As the strainer cavity 116 fills, it raises a float 118*a*. When the float 118*a* reaches the top of its travel, it activates a switch 118*b* used to turn on the current from the battery 76 to energize the pump 80. A pump impeller 120 sucks oil from the strainer cavity 116 through an inlet port 122 and out through a port 124. From the port 124, oil flows up through a tube 126 through a check valve 128 and into the storage container 78. When the storage container 78 reaches capacity, a float sensor switch 130, similar to the one in the strainer cavity 116 and mounted at the top of the storage container (FIG. 2), shuts off the current to the pump 80. The canister assembly 12 stays in the well until the programmable timer 186 mounted in the electrical enclosure 22 energizes a drive motor relay 180 to start the spool motor/gearbox assembly 24 to pull the load of oil up to the discharge head 40. Once in the discharge head 40, the oil is discharged as described above and the battery 76 is charged before the cycle starts over.

With regard to the alternative canister assembly depicted in FIG. 3A, oil enters through the opening formed by the channel 57A. The other opening formed by channel 57B is preferably higher on the nose portion than the opening formed by channel 57A. This construction would facilitate filling the canister by allowing air that might otherwise be trapped in the canister to easily escape through the channel 57B (as indicated by arrow 103A in FIG. 3A) as oil enters channel 57A (as indicated by arrow 103B in FIG. 3A).

The capacity of oil pumped is determined by several factors; the diameter of the well, the size or length of the storage container, the number of cycles of the extractor in a 24-hour period, the depth of the well, the producing capability of the well, and the time that is required to charge the battery. For example, if the storage container 78 is designed to hold 5 gallons of fluid, to produce a barrel of oil (42 gallons) it would require 8.4 pulls or cycles of collecting and discharging oil from the storage container 78. This example assumes that the well depth is approximately 1000 feet. Given that depth and depending on the size motor that is used, it will take about 20 minutes for the canister to travel down the well, 10 minutes to fill the storage container 78, 20 minutes up to pull the canister assembly 12 up from the well, and 10 minutes to discharge the oil and charge the battery. In other words, by appropriately setting the timers one cycle would take a total of 60 minutes. In a 24-hour period the unit will extract 120 gallons of oil or 2.9 barrels in the 24-hour period. By way of another example, using the same assumptions, if the storage container held 10 gallons, the unit could produce 5.8 barrels in a 24-hour period.

The Jogging System

Figure 6:
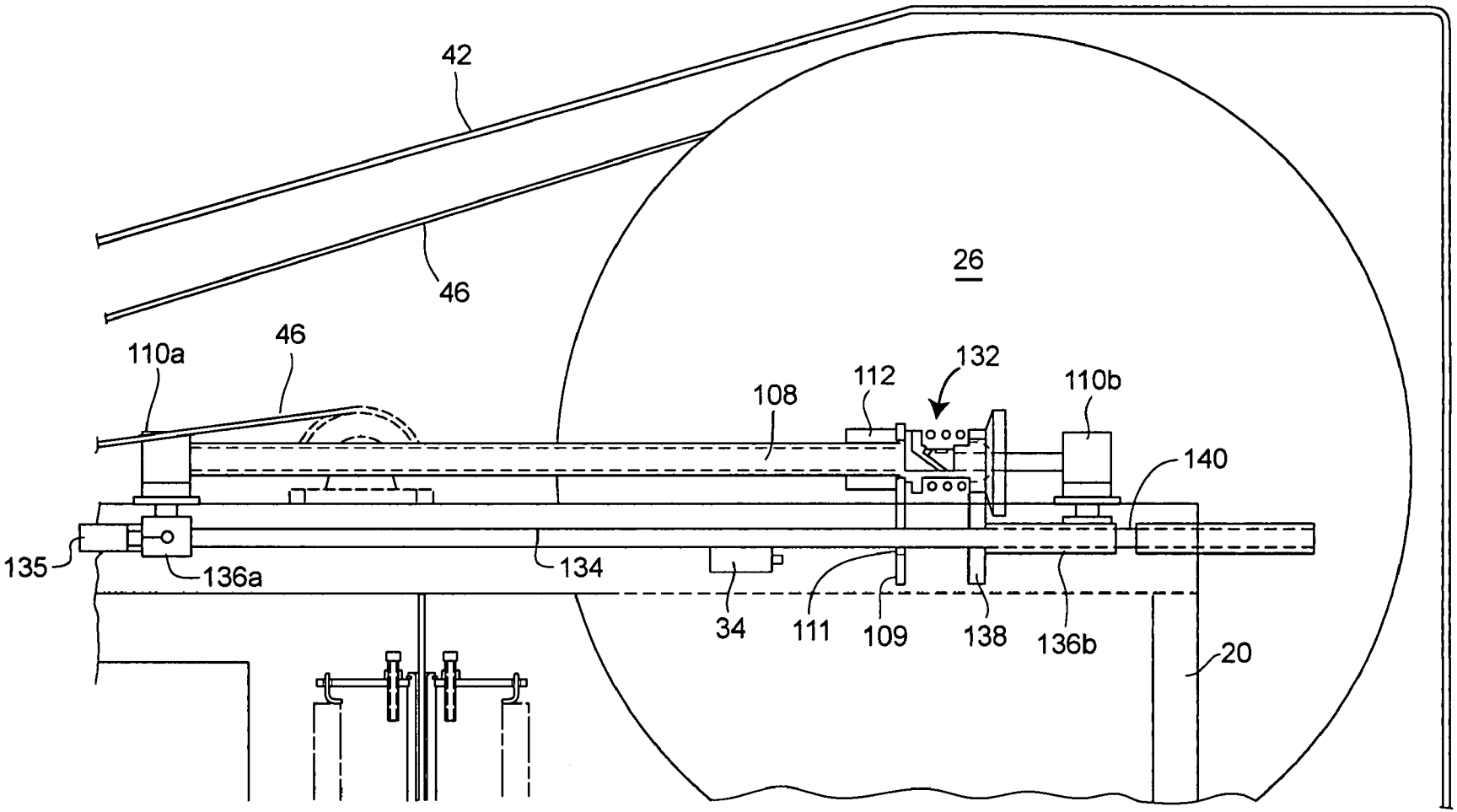
FIG. 6 is a schematic diagram of a jogging assembly attached to the base assembly for incrementally lowering the canister assembly.

To maximize the efficiency of the extractor system a jogging system is preferably mounted to the extractor system. A preferred embodiment of the jogging system is shown in FIG. 6. The jogging system includes a lead screw 108 that is connected to the spool of cable 26 by a cam assembly 132. The cam assembly 132 causes the lead screw 108 to rotate in place whenever the spool of cable 26 rotates. The cam assembly 132 will be discussed in greater detail below. As described above the pillow blocks 110*a* and 110*b* are used to secure the lead screw 108 to the base assembly 20 in such way as to allow it to rotate along its axis as the spool of cable 26 rotates. The follower 112 is threaded onto the lead screw 108 and has a cam guide 109, which extends down from the follower 112. The cam guide 109 is basically a metal plate attached to the follower 12. A threaded jogging rod 134 is mounted to fit through a hole 111 provided in the cam guide 109. The hole 111 is sized with enough clearance to allow the jogging rod 134 to slide therein without any substantial frictional interference. As the spool of cable rotates 26 to lower the canister assembly 12 into the well, the follower 112 moves toward the limit switch 34, which is attached to the threaded jogging rod 134. As described above this switch is used to shut off the motor/gear assembly 24 of the extractor to stop the canister assembly 12 from being lowered further into the well. The position of the limit switch 34 is preferably placed at a point on the threaded jogging rod 134 that translates to the top of the oil column in the well where the canister assembly can be placed to extract oil. Thus moving the switch to the left or away from the spool of cable as shown represents or translates to lower travel depths in the well. The switch 34 is activated when the cam guide 109 makes contact with it.

The threaded jogging rod 134 is mounted below the lead screw 108 using anti-rotational blocks 136*a* and 136*b*. The anti-rotational blocks 136*a* and 136*b*, which may be made of square metal tubes, are sized to allow the jogging rod to freely slide back and forth within them. The jogging rod 134 is connected to the cam assembly 132 by a slave gear 138 that has an internal threaded portion (not shown) that mates with the threads of the jogging rod 134. In operation the slave gear 138 rotates when the follower 112 is compressed against the cam assembly 132, which occurs when the canister assembly 12 is coupled to the discharge head 40 to remove oil from the storage container 78. The cam assembly 132 also works in combination with the anti-rotational blocks 136*a* and 136*b* to permit the jogging rod 134 to slide only in a direction away from the spool of cable 26, thereby increasing the length or distance that the follower 112 will have to travel to turn off the spool/motor gear assembly 24. A spring 135 connected between the jogging rod 134 and the anti-rotational block 136*a* is used to provide bias tension.

A detent (not shown), which may be attached to the structural platform 20, slides over the gears of the slave gear when it rotates in the direction that moves the limit switch 34 away from the spool of cable. The detent prevents the slave gear 138 from rotating in the other direction. This action will be discussed in more detail during the discussion of the cam assembly 132 below. As a result, the limit switch 34 is incrementally moved to the left thereby increasing the distance that the follower has to travel to make contact with the limit switch to stop the extractor assembly from dropping the canister assembly 12 further into the well.

A shut-off slot 140 is provided on the jogging rod as shown to prevent the slave gear 138 from sliding the jogging rod too far from the spool of cable and serves as the mechanism for limiting the travel of the canister assembly down in the well. In other words, this depth generally represents the depth in the well where an interface of oil and water exists and will be the lowest depth that the canister assembly is allowed to travel down in the well. It is desirable not to allow the canister assembly to travel at depths below that point because only water or a mixture of water and oil will be recovered. It may also represent the bottom of the well. Machining a portion of the treads off of the jogging rod can easily create this shut-off slot 140.

Figure 7:
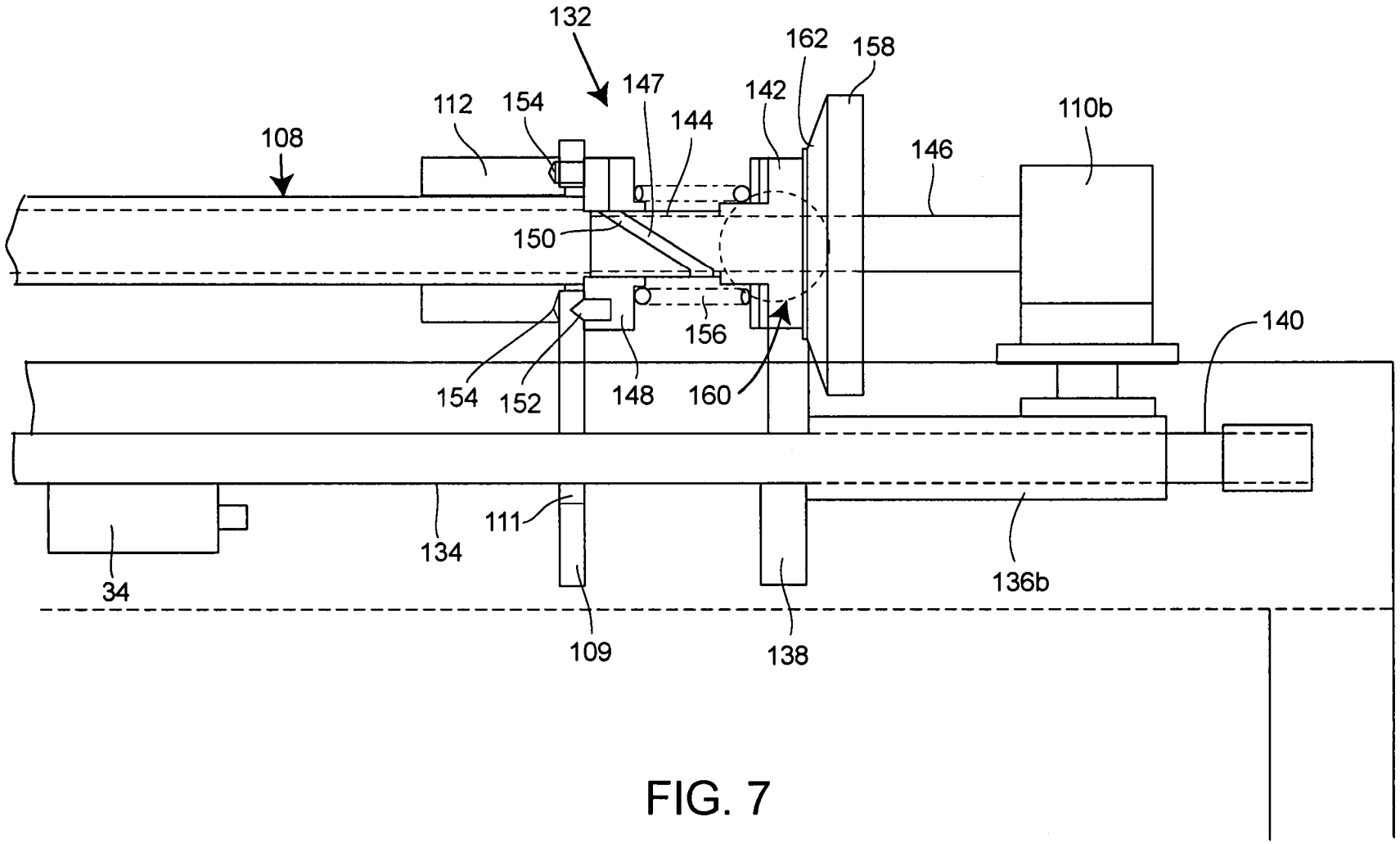
FIG. 7 is a more detailed schematic diagram of a cam assembly of the jogging assembly of FIG. 6.

The cam assembly 132 will now be described. Referring now to FIG. 7 the cam assembly 132 includes a drive gear 142 that mates with the slave gear 138. The drive gear 142 has a sleeve portion 144 that has a cam slot 147 formed along its length as shown. Both the drive gear 142 and its sleeve portion 144 are sized to allow them to easily rotate without interference over a shank portion 146 of the lead screw 108 that has been machined to have a smaller diameter. The drive gear 142 is held in place by a beveled gear 158, which is attached to the shank portion 146 and mates with a gear 160 (shown in phantom) attached by suitable means to the axial of the spool of cable. A thrust bearing 162 is placed between the drive gear and the beveled gear to reduce friction and prevent wear on either part. As the spool of cable rotates, gear 160 rotates causing the beveled gear 158 to rotate thereby rotating the lead screw 108. As the lead screw 108 rotates, the treads of the lead screw move the follower 112. The follower 112 is prevented from rotating because the jogging rod 134 acts as a stop for the cam guide 109. A dog collar 148 is sized to fit over the sleeve portion 144 of the drive gear to allow it to freely slide over the sleeve portion 144. The dog collar 148 has an inner diameter that is positioned to butt up against the larger diameter of the lead screw as shown. In other words the collar is sized to easily slide over the sleeve but not the threaded portion of the lead screw, which will serve as a stop for the collar. A pin 150 is positioned in the dog collar 148 as shown and extends into the cam slot 147 formed in the sleeve portion 144. A second pin 152 is placed in the collar 148 and is used to fit in one of several holes 154 formed in the follower 112 when it comes into contact with the cam assembly 132. Preferably the second pin 152 is pointed as shown so that it can easily find its way into one of the holes formed in the follower. Although it is not clearly shown, multiple holes are preferably formed along the radius of the follower in relation to the lead screw and correspond to the radius of the second pin in relation to the lead screw. The reason for these multiple holes will become clearer in view of the discussion below. A bias spring 156 is placed between the collar 148 and the drive gear 142 to bias the collar against the larger diameter of the lead screw 108. This bias helps to keep the second pin 152 engaged into one of several holes formed in the follower.

The operation of the cam assembly will now be described. As already mentioned, the travel distance of the follower to the limit switch determines the depth of canister assembly in the well. The object of the jogging assembly is to incrementally lower the canister assembly in the well to maximize the time and efficiency of the fluid recovery. The incremental lowering adjustments are made when the canister assembly is brought to its home position (fully retracted out of the well and engaged with the discharge head 40). In the home position the follower compresses up against the collar. As the follower moves toward the collar, the second pin finds and engages with one of the multiple holes in the follower. As the follower compresses against the collar it causes the collar to slide over the sleeve portion 144 and toward the drive gear 142. As it does this, pin 150, traveling in the cam slot 147 formed in the sleeve portion, causes the sleeve portion and thus the drive gear to rotate. As a result the drive gear rotates the slave gear 138, which causes the jogging rod to move in a direction away from the spool of cable. The amount of compression or travel of the collar along the sleeve portion determines the incremental amount that the jogging rod will slide away from the spool of cable and thus the distance of the limit switch from the cam guide. The user predetermines this amount of travel along the collar by positioning it at that location with the canister assembly in the home position. The net result in the movement of the jogging rod translates to the amount that canister assembly is incrementally lowered into the well. In other words, the amount of travel of the pin along the slot portion will determine the amount the canister assembly will be incrementally lowered down the well during its next trip down. For example, causing the follower to compress the cam assembly approximately ⅛ of an inch could result in lowering the canister assembly 4 inches in the well. Of course it should be appreciated by one skilled in the art that the actual jogging amount will vary depending on several variables such as the diameter of the cable of spool, the sleeve, drive gear, slave gear, etc. The actual amounts can be determined experimentally by trial and error or by calculating using the known diameters of the various parts mentioned above.

As the canister assembly is once again lowered into the well the follower moves toward the limit switch 34. The position of the drive gear and thus the sleeve portion is prevented from returning to its previous position by the detent. As the follower moves away from the collar, the second pin becomes disengaged from the hole in the follower. When this occurs, the collar rotates relative to the sleeve portion to a new position as it slides toward the stop formed by the larger diameter of the lead screw and guided by the pin 150 in the slot portion 146 of the sleeve. Because of this rotation action of the collar, when the follower returns, the second pin will find a new hole in the follower and the process of turning the drive gear repeats.

It should become apparent to one skilled in the art in view of the concept of the mechanical jogging assembly described above that other types of jogging units could be created to accomplish the same jogging concept. For example, a magnetic pickup device could be used to detect magnets strategically placed on the spool of cable to determine the number of rotations the spool takes and thus the depth the canister assembly is placed into the well. Electronically the motor/gear assembly could then be controlled to turn off the motor/gear assembly to successively lower the canister assembly to new predetermined levels in the well every cycle. Other types of jogging assemblies to accomplish the disclosed jogging concept should also become apparent to one skilled in the art.

CONCLUSION

It should be clear from the above description that the oil extractor has several advantages. The overall unit is designed to be compact and light in weight. In the preferred embodiment, the over all dimensions of this unit are approximately 57" in length, 21" wide and 33" in height and can be built to weigh less than 500 pounds. With a hoist mounted on a pickup truck, one individual will be able to install and setup the extractor onto a well, eliminating the need for heavy equipment and numerous personnel to install that would otherwise be required for other prior art pumping devices. This will significantly reduce setup costs when compared to the standard pump jack setup time. Of course the actual design and weight of the unit could vary depending on pumping capacity or fluid that the unit is designed for handling. For example, a larger compressor or motor may be needed depending on the application of the unit. Further, the preferred unit is designed to use a ¾ horsepower electric motor to extract the oil, compared to 10–40 horsepower motor used on today's pumping units. An 80–90% reduction in the amount of electricity required to pump a barrel of oil should be realized.

While the basic components and structure of the base assembly and the canister assembly was described in greater detail above, it should be understood by one skilled in the art that several modifications could be made without departing from the sprit and scope of the invention. For example, rather than using a battery to power the pump in the canister assembly, the cable used to lower the canister assembly could be a multi-strand wire that also serves to power the pump. Other similar modifications should be apparent as well. For instance, the diameter of the canister assembly will depend on the diameter of the well. The length will depend on the desired amount to be recovered by each cycle. Device substitutions or configurations could also be made without parting from the spirit and scope of the invention. Depending on the application., various sized pumps and motors could be used. Different types of electrical contacts or air passageways or ports could be used or configured too. Other types and configurations of electrical components used in the electrical enclosure could also be used depending on the application. For example as illustrated in the electrical schematic diagram shown in FIG. 9, a DC electrical circuit design could be used to power a DC motor 170, rather than the AC electrical circuit depicted in FIG. 8. Preferably this circuit uses standard off the shelf electrical components such as a single pole, single throw relay switch 172, a double pole, double throw relay switch 174, two timers 176, 178, a DC powered compressor 180, and relay switches 182, 184, 186, 188. As illustrated, the electrical diagram shows a positive terminal of a battery 190, which could be a 12 Volt battery, supplying power to a terminal of the single pole, single throw relay switch 172 as shown. This relay switch is used an on/off switch for the motor as illustrated. Relay switch 174 is used to control the direction the motor. A fuse 175 can be use to insulate the circuit from excessive current. Power is also fed through an on/off switch 192, which would allow a user to turn the extractor on or off. Once the power is turn on, power is supplied to 2 relay switches 184, 186, which are used as safety switches. The safety switches are preferably wired to be in a normally closed switch position, so that if the switch is activated, the switch cuts the power (through relay 172) to shut off the motor. One switch 184 is used as a back up limit switch to an up detection limit switch 182, which detects when the canister assembly has fully engaged the discharge head as evidenced by the raising of the discharge head. This safety switch 184 is preferably placed just slightly above the up detection limit switch and primarily used to detect when the discharge head is raised too high or if the up detection limit switch fails. The other safety switch 186 is placed on the jogging assembly (FIG. 7)

next to the down detection limit switch, as described above, and used to detect when the canister has exceeded the maximum depth should a down detection limit switch 188 fail. While in the normally closed-switch position the safety switches allow power to be supplied to a double pole, double throw cycle timer 178, which is used to time the various functions of extractor unit, such as how long the canister assembly is placed down in the well to collect fluid and time at the top. This timer can also be used to power a counter 194 to keep track of the number of cycles made by the extractor unit. The other timer 176 is used to turn on the compressor 180 when the up limit switch 182 redirects power to it as illustrated by the wiring. This timer controls the amount of time the compressor is on to pump the fluid out of the canister assembly. While the wiring diagram has been generally discussed, an electrician or one skilled in the art should easily understand the schematic shown. The same level of understanding would apply to the electrical schematic diagram shown in FIG. 8.

In view of the discussion above I claim:

1. An extractor for extracting fluid from a well comprising:

a canister assembly having a storage container for storing fluid extracted from the well and a nose portion at the top of the canister assembly, wherein the nose portion has a first hole for allowing well fluid to flow into the storage container when the storage container is lowered into the well, a second hole connected to a tube that extends along the interior length of the storage container, and a third hole for venting air from the storage container as well fluid flows into the storage container through the first hole; and a base assembly for lowering and raising the canister assembly into and out of the well, wherein the base assembly has a discharge head for engaging with the canister assembly when it is raised from the well to permit pressurized air to enter the storage container through the first and third holes for removing fluid from the storage container through the tube and second hole.

2. The extractor of claim 1 wherein the base assembly includes a motor and a spool of wire connected to the canister assembly, wherein the motor is used to drive the spool of wire to raise and lower the canister assembly into and out of the well.

3. The extractor of claim 2 wherein the motor is an AC motor.

4. The extractor of claim 2 wherein the motor is a DC motor.

5. The extractor of claim 1 further including a timer for determining the amount of time the canister assembly is placed into the well to extract fluid.

6. The extractor of claim 1 wherein the base assembly further includes a jogging assembly for incrementally lowering the canister assembly to lower levels in the well with each recovery cycle.

7. The extractor of claim 6 wherein the jogging assembly provides a means for limiting the travel depth of the canister assembly lowered down a well.

* * * * *